US007968044B2

(12) United States Patent
Rocha et al.

(10) Patent No.: US 7,968,044 B2
(45) Date of Patent: Jun. 28, 2011

(54) SINTER PROCESSING SYSTEM

(75) Inventors: Edson Rocha, Sao Caetano do Sul (BR); Marcos Torres, Santo Andre (BR)

(73) Assignee: Spraying Systems Co., Wheaton, IL (US)

( * ) Notice: Subject to any disclaimer, the term of this patent is extended or adjusted under 35 U.S.C. 154(b) by 136 days.

(21) Appl. No.: 12/111,324

(22) Filed: Apr. 29, 2008

(65) Prior Publication Data

US 2008/0264206 A1 Oct. 30, 2008

Related U.S. Application Data

(60) Provisional application No. 60/926,930, filed on Apr. 30, 2007, provisional application No. 60/927,979, filed on May 7, 2007.

(51) Int. Cl.
*C22B 1/20* (2006.01)

(52) U.S. Cl. ..... 266/87; 266/178; 266/192; 134/131

(58) Field of Classification Search ..... 266/192, 266/177, 178, 87; 134/131
See application file for complete search history.

(56) References Cited

U.S. PATENT DOCUMENTS

| | | | | |
|---|---|---|---|---|
| 6,048,381 | A * | 4/2000 | Kepplinger et al. | 75/436 |
| 7,618,476 | B2 * | 11/2009 | Ichikawa et al. | 75/484 |
| 2004/0262822 | A1 | 12/2004 | Ichikawa et al. | |

FOREIGN PATENT DOCUMENTS

| | | | |
|---|---|---|---|
| EP | 1445335 | A1 | 8/2004 |
| JP | 2001-220625 | A | 8/2001 |
| KR | 10-2004-0059522 | A | 7/2004 |
| KR | 10-0544580 | B1 | 1/2006 |

OTHER PUBLICATIONS

Machine translation of KR 10-2002-0084770 published Jul. 6, 2004.*

* cited by examiner

*Primary Examiner* — George Wyszomierski
*Assistant Examiner* — Tima M McGurthy-Banks
(74) *Attorney, Agent, or Firm* — Leydig, Voit & Mayer, Ltd.

(57) ABSTRACT

An apparatus and method for processing iron sinter is provided. A cooling system is arranged downstream of a furnace for cooling the iron sinter. The cooling system includes a convective cooling system for forcing air into the iron sinter and an evaporative cooling system for directing fluid into the hot sinter.

17 Claims, 12 Drawing Sheets

SINTER PROCESSING SYSTEM

CROSS-REFERENCE TO RELATED APPLICATIONS

This patent application claims the benefit of U.S. Provisional Patent Application No. 60/926,930, filed Apr. 30, 2007 and U.S. Provisional Application No. 60/927,979, filed May 7, 2007, which are incorporated by reference.

FIELD OF THE INVENTION

This patent disclosure relates generally to iron processing, and, more particularly to a system for efficiently and effectively processing sinter used in the production of processed iron.

BACKGROUND OF THE INVENTION

The production of steel involves a number of processing steps in which iron-containing ores and particles are refined into iron metal. One step that is very important in that process is using a blast furnace to consume iron oxides in a number of forms and reduce these input materials into metallic iron. Iron oxides can be provided to the blast furnace in the form of raw ore, pellets or sinter. Raw ore comprises iron ore (Hematite ($Fe_2O_3$) or Magnetite ($Fe_3O_4$)) that is mined and then sized into pieces from about 0.5 to about 1.5 inches diameter. Such ore can have relatively high iron content between about 50% and 70%. This raw ore is considered to be of high quality since it can generally be fed directly into a blast furnace without further processing.

Iron ore that has lower iron content is typically processed to eliminate waste material and increase iron content. In particular, iron-rich pellets can be produced by crushing and grinding the low iron content ore into a powder so that waste material, sometimes called gangue, can be eliminated. The remaining powder is then formed into small pellets and fired in a furnace. The finished pellets have about 60% to 65% iron content.

As noted above, iron sinter may also be used to feed the blast furnace. Sinter is an irregular porous material, generally in the form of small pieces, that is produced by firing a combination of granular raw ore, coke, and limestone with iron-containing steel processing waste materials. Coke is a particulate form of processed coal, and limestone is a mineral used as a flux to remove impurities from the mixture. These materials are mixed in desired proportions and introduced into a sintering production line.

Of the three feed types for a blast furnace, sinter is typically the least expensive, and thus it is desirable to use a larger portion of sinter in the blast furnace feed mix when possible. In addition, some amount of sinter is generally desired in order to adjust the metallurgy of the finished iron product. However, one significant limitation on the use of sinter is the efficiency and effectiveness of the sintering process. In particular, known sinter processing systems have limitations which impede sinter production rates and adversely affect the quality of the sinter. As a result of these limitations, sinter cannot be used to feed blast furnaces as much as would otherwise be desirable.

The foregoing background discussion is intended solely to aid the reader. It is not intended to limit the invention, and thus should not be taken to indicate that any particular element of a prior system is unsuitable for use within the invention, nor is it intended to indicate any element, including solving the motivating problem, to be essential in implementing the innovations described herein. The implementations and application of the innovations described herein are defined by the appended claims.

OBJECTS AND SUMMARY OF THE INVENTION

In view of the foregoing, it is a general object of the present invention to provide a more efficient and thus more economical system for processing sinter used in the production of processed iron.

A related object of the present invention is to provide a sinter processing system that enables more sinter to be used among the feed materials for a blast furnace which leads to processed iron that is more economical and of higher quality.

A further object of the present invention is to provide a sinter processing system that produces sinter of improved quality.

A more specific object of the present invention is to provide a sinter processing system in which the sinter is cooled more quickly and uniformly.

Additional and alternative features and aspects of the disclosed system and method will be appreciated from the following description.

DETAILED DESCRIPTION OF THE INVENTION

Figure 1:
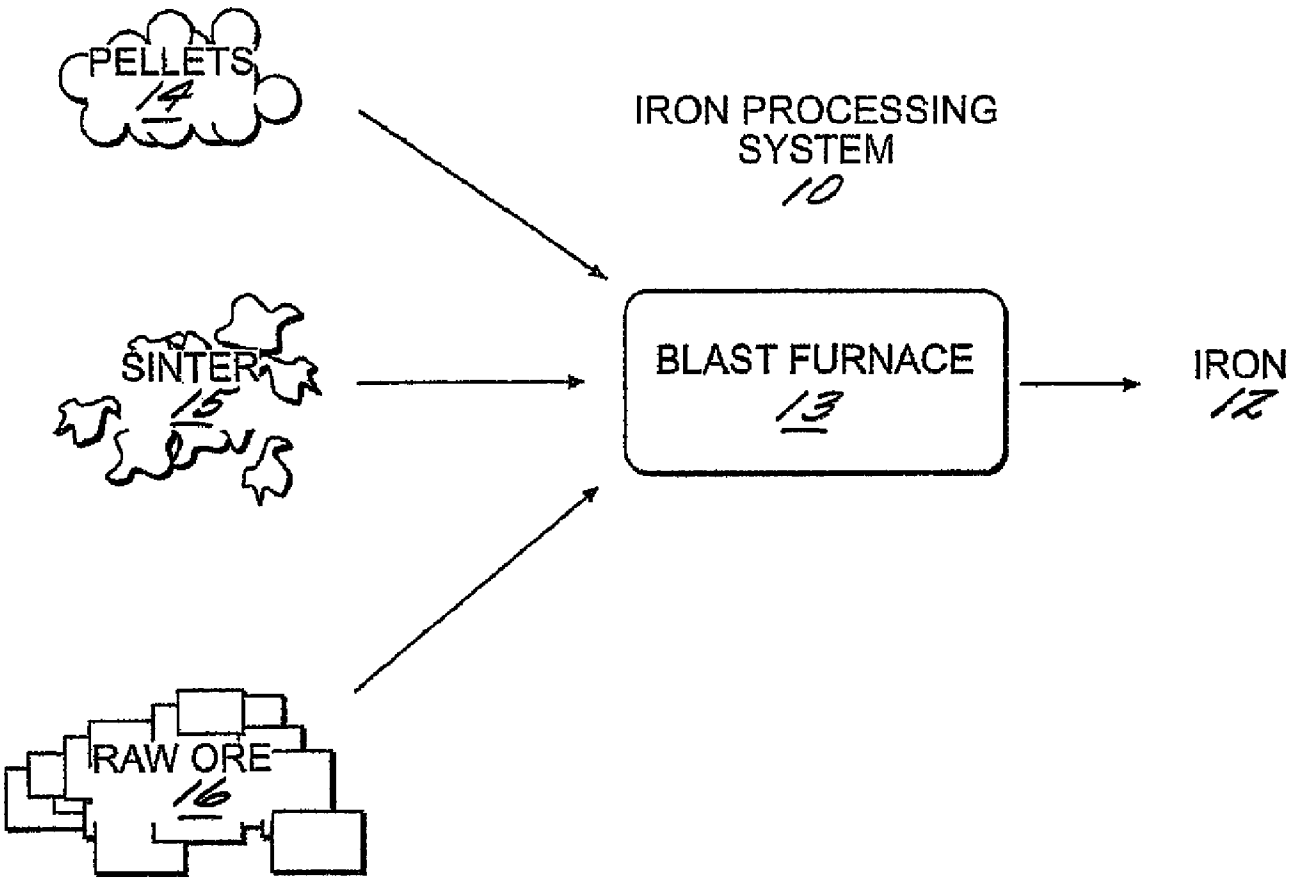
FIG. 1 is a schematic flow diagram of an illustrative basic iron oxide reduction process.

Referring now more particularly to the drawings, there is shown in FIG. 1 a known iron processing system 10 for producing metallic iron 12 from a number of sources of iron oxide. The system 10 comprises primarily a blast furnace 13 as well as conveyors, cars, etc., for conveying oxide-rich starting materials into the furnace 13, and for removing the resulting metallic iron 12 from the furnace 13. In the illustrative system, the oxide-rich starting materials include pellets 14, sinter 15, and raw ore 16. Of these, the sinter 15 is of the lowest cost, however, the proportions of pellets 14, sinter 15, and raw ore 16 used in any particular mix will depend largely upon the desired out product.

Although it is not necessary to understanding the present invention, it will be appreciated that the blast furnace 13 operates by chemically reducing and physically converting the iron oxides into molten metallic iron. Typically, the raw materials are loaded into the top of the furnace 13 and descend through the furnace to the bottom over the course of several hours. By the time the raw materials reach the bottom of the furnace 13, they will have been converted into slag (waste liquid) and liquid iron, which are periodically drained off and removed for disposal or further processing.

As noted above, sinter 15 is the least costly of the feed materials for the blast furnace as well as a desirable ingredient with respect to adjusting the metallurgy of the finished iron product. Thus, the rate and efficiency with which usable sinter 15 can be produced will have a substantial impact on the production rate and efficiency of the overall iron production process 10.

Figure 2:
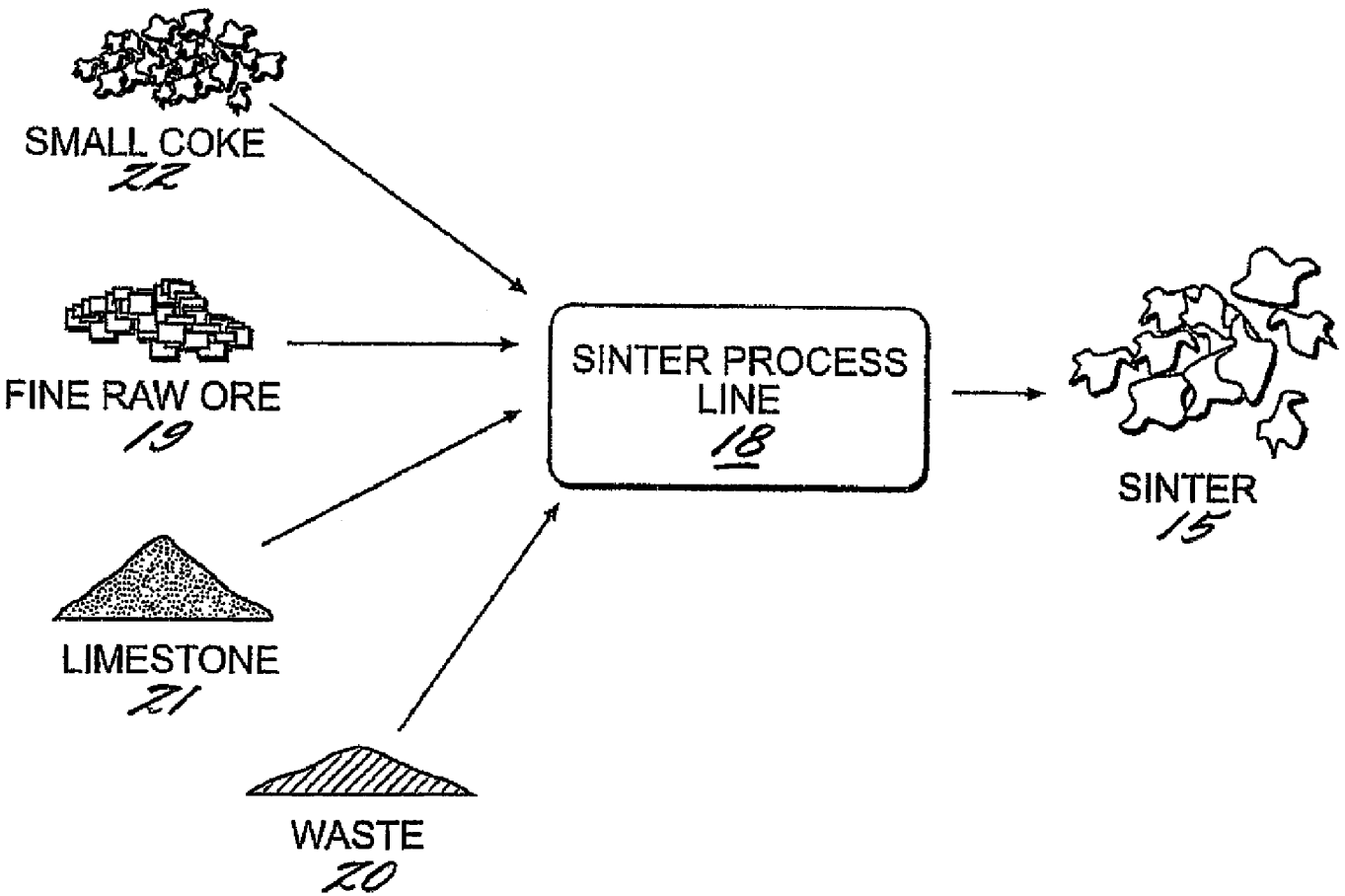
FIG. 2 is a schematic flow diagram illustrating generally the combination of starting materials that can be used to produce iron sinter using a sinter process line or system according to the present invention.

In accordance with the invention, the iron sinter 15 for the blast furnace can be produced by a sinter processing system 18 that is adapted for more efficient and effective production of high quality iron sinter. An illustrative sinter processing system 18 is shown in a highly schematic fashion in FIG. 2. In general, the sinter processing system 18 takes as input a number of material products 19-22 and provides as its output a quantity of iron sinter 15. The input materials 19-22 typically comprise an oxide source such as raw ore 19 and iron waste products 20. In addition, a flux material such as limestone 21 as well as a fuel material such as coke 22. Typically the raw ore 19, limestone 21, and coke 22 are finely ground or crushed to improve reactivity and to speed melting and mixing. The output sinter 15 is filtered or separated to remove small particles (less than 0.5" diameter) for recycling or disposal.

Figure 3:
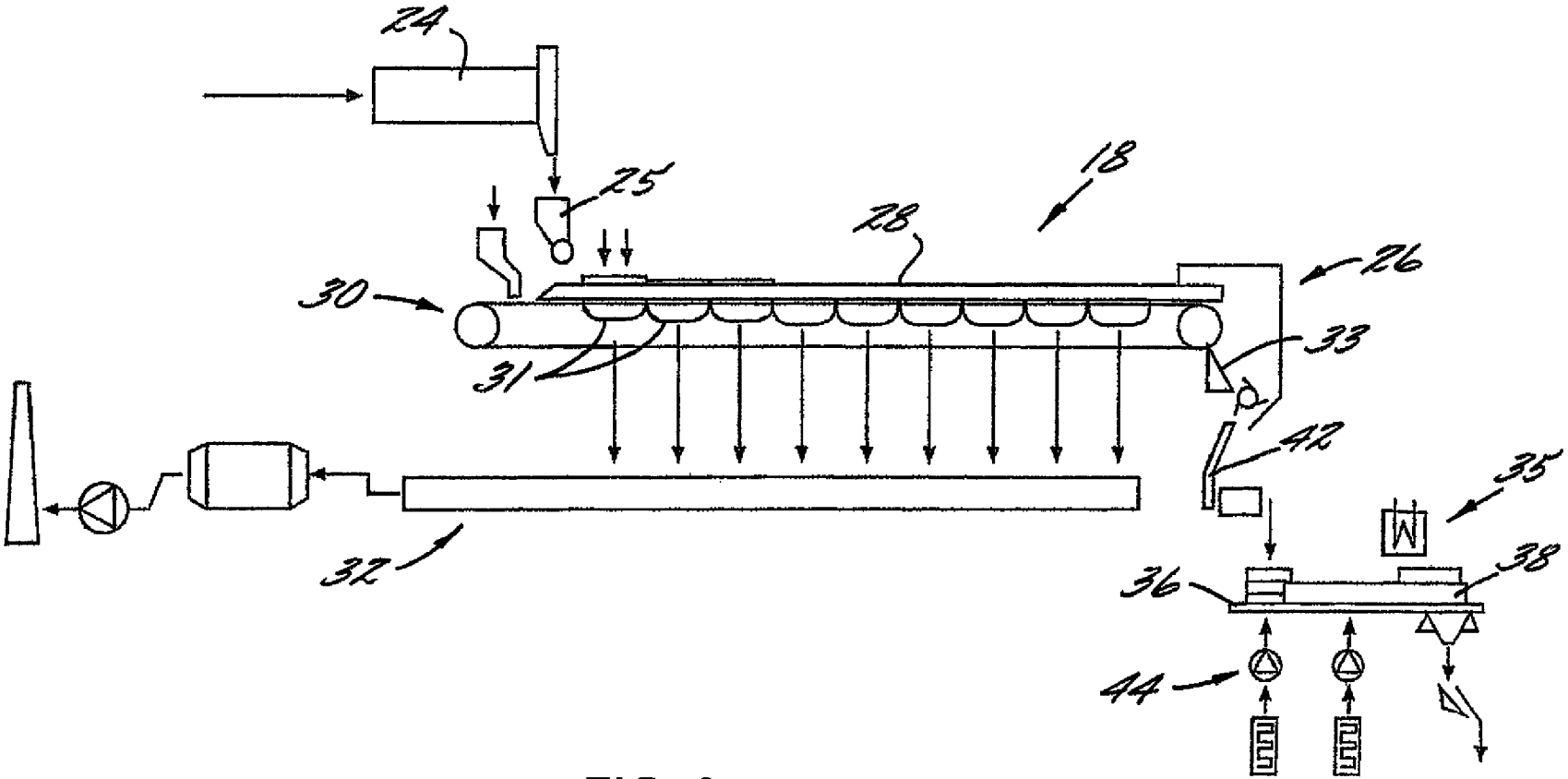
FIG. 3 is a schematic diagram showing in more detail the illustrative sinter processing line of FIG. 2.

The exemplary sinter processing system 18 is shown in more detail in FIG. 3. In the illustrated embodiment, the raw sinter input materials 19-22 are first blended together and stored in a storage bin 24. The sinter mix is then fed via a feeding station 25 from the storage bin 24 to a heating stage 26 of the processing system which includes, in this case, an ignition furnace 28. The feeding station 25 deposits the sinter mix on a conveyor 30 which transports the sinter mix through the combustion chamber of the ignition furnace 28. The illustrated conveyor 30 consists of a number of pallet cars 31 each of which can receive a bed of sinter mix to a desired depth. In a known manner, as it travels through the ignition furnace 28, the mixture of input materials 19-22 is ignited and fused by the heat of the burning coke into larger pieces.

The rate at which materials can be moved through the heating stage 26 will depend largely upon the ability of the furnace 28 to ignite the coke to heat the input materials 201-204. There are generally no structural or metallurgical limits on the heating rate, but rather only on the maximum heating temperature. In other words, it is desirable to quickly heat the input materials, but not to exceed a certain upper temperature limit such as 700° C.

The illustrated ignition furnace 28 is further equipped with a combustion gas scrubbing system 32 that transports the combustion gases away from the furnace 28 and cleans them so that they can be vented to atmosphere. The ignition furnace 28 also can include a waste gas recirculation system that takes a portion of the waste combustion gases produced by the furnace and re-circulates them back into the furnace in order to improve its efficiency.

The sinter cannot be further processed or used until it is cooled after passing through the ignition furnace 28. Thus, upon exiting the end of the ignition furnace 28 through a discharge chute 33, the hot sinter 34 is transferred to a cooling stage or system 35, which in this instance comprises a cooler unit 36. The illustrated cooler unit (also shown in FIGS. 4 and 5) consists of a carousel type annular conveyor 38 including a plurality of cooler troughs that run on rails around the conveyor. The carousel conveyor 38 is supported on a base 40 which carries the rails for the cooler troughs (see FIGS. 7 and 8). As will be appreciated by those skilled in the art, other types of conveyor/cooling systems in the cooling stage. For example, a cellular type, a horizontal table type or a liner suction type cooler unit could be used.

In the illustrated embodiment, the hot sinter 34 is fed onto the carousel conveyor 38 by a charging system 42 (see FIG. 3) that receives the hot sinter from the discharge chute 33 and distributes it substantially evenly in the cooler troughs. Once it has been sufficiently cooled, the sinter is discharged from the carousel conveyor 38 to a collection hopper or to a further conveyor for transport to a screening area and ultimately to a collection area.

In accordance with the invention, the cooling system of the sinter processing line cools the hot sinter much more quickly and uniformly than cooling systems presently used in sinter processing plants. As will be appreciated by those skilled in the art, it is advantageous to cool the sintered material as quickly as possible to promote increased throughput. Heretofore, limitations regarding the rate at which the sinter could be cooled have been a significant obstacle to increasing the throughput of sintering processing systems and, in turn, to optimizing the amount of sinter that is used to charge the blast furnace. In particular, with current systems, the sinter temperature is limited at the upper end because the heat can lead to damage to the conveyor systems. This can create a production bottleneck. The cooling system 35 of the present invention helps eliminate this bottleneck by enabling the sinter processing system 18 to operate with a significantly higher production rate and thus the resultant sinter produced by the process is more economical. Moreover, the cooling system 35 cools the sinter at a rate and uniformity that promotes beneficial metallurgical properties such as increased shatter resistance and a corresponding increased yield of large sinter pieces. While the present invention is described in the context of a sinter processing line, it is believed that the cooling system of the invention could also be employed to beneficial effect in the context of pellet processing.

Figure 4:
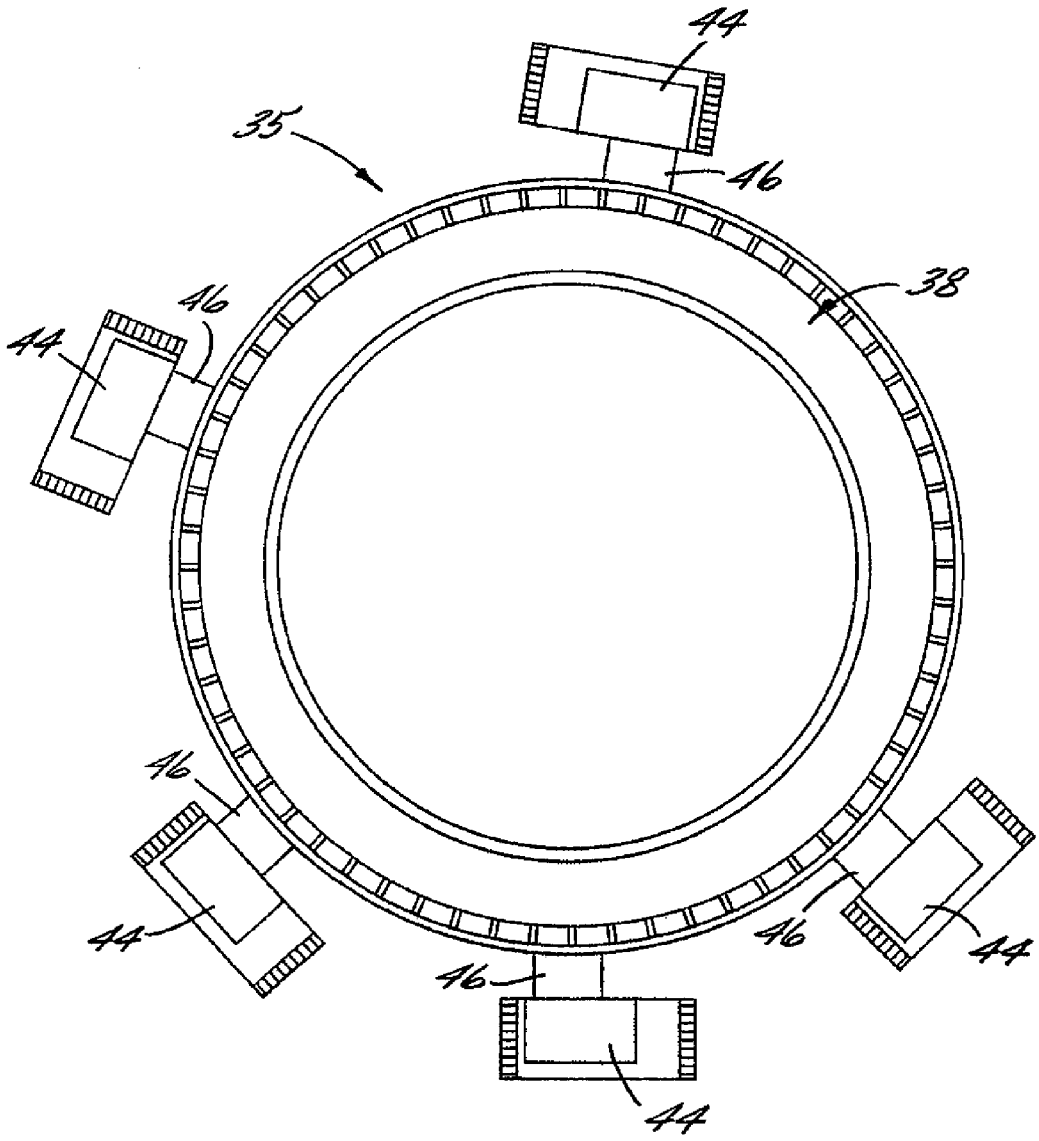
FIG. 4 is a top view of the sinter cooling system including the carousel conveyor of the sinter processing line of FIG. 3.

To this end, the sinter cooling system 35 employs both convective and evaporative cooling. For providing convective cooling, a plurality of fan units 44, in this case five, are arranged in circumferentially spaced relation about the perimeter of the carousel conveyor 38 as shown in FIG. 4. An air chamber 45 defined by the base 40 of the carousel conveyor 38 extends beneath the conveyor. Each fan unit 44 consists of a large fan that directs air through a discharge plenum 46 into the air chamber 45. During operation, the fan units 44 force air into the air chamber 45 and from there upwards through the hot sinter 34 on the carousel conveyor 38 to promote convective cooling.

Figure 8:
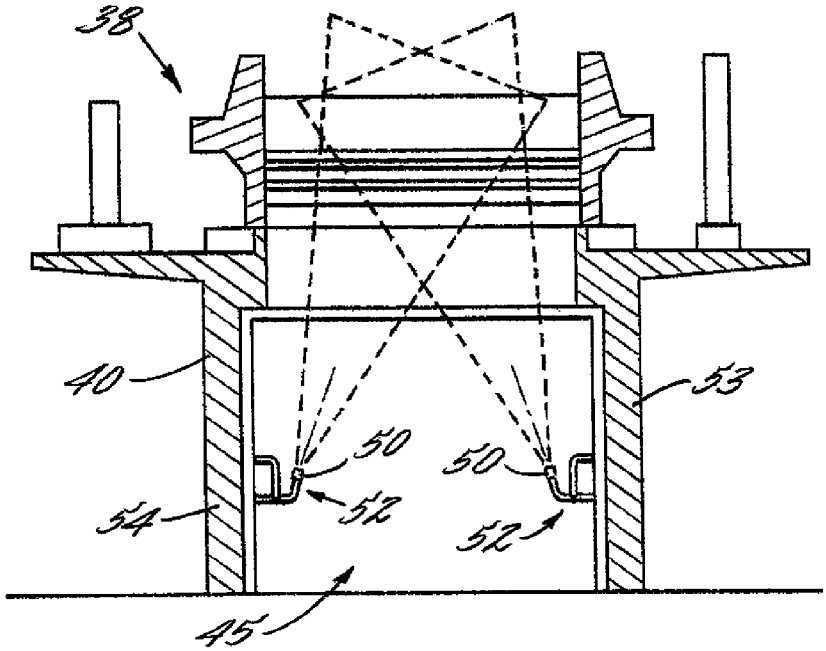
FIG. 8 is a lateral cross-sectional view of the air chamber beneath the carousel conveyor of FIG. 4 showing the spray nozzles of one of the evaporative cooling units.

In keeping with the invention, to provide optimal cooling of the sinter, the cooling system 35 according to the invention further includes one or more evaporative cooling units 48. In the illustrated embodiment, the cooling system 35 includes a total of three evaporative cooling units 48 each of which includes a plurality of air-atomizing spray nozzles 50 for discharging liquid, preferably water, into the hot sinter carried on the carousel conveyor 38 as shown in FIGS. 5-8. More particularly, as shown in FIGS. 7 and 8, the spray nozzles 50 of each evaporative cooling unit 48 are arranged beneath the carousel conveyor 38, in this case in the air chamber 45, and are disposed to discharge upwards into the hot sinter carried on the conveyor. It is desirable that the spray nozzles 50 of each evaporative cooling unit 48 discharge just enough water that superheated steam is created when the water contacts the hot sinter. If too much water is discharged, the sinter can become overly wet, which can be problematic relative to the further processing of the sinter. In addition, with too much water, the area in the vicinity of the cooling system can become overly humid which can also create difficulties. Too much water also can cause blockages in the screens downstream from the carousel conveyor 38 that can necessitate time consuming cleaning operations.

As will be appreciated by those skilled in the art, the evaporative cooling units of the present invention can be used with types of cooler units other than the illustrated annular carousel conveyor cooler. In the case of the other types of cooler units (e.g., cellular, horizontal table, linear suction), it also preferred that the spray nozzles be installed in the air passages or ducts upstream (relative to the airflow direction) from the hot sinter.

Figure 5:
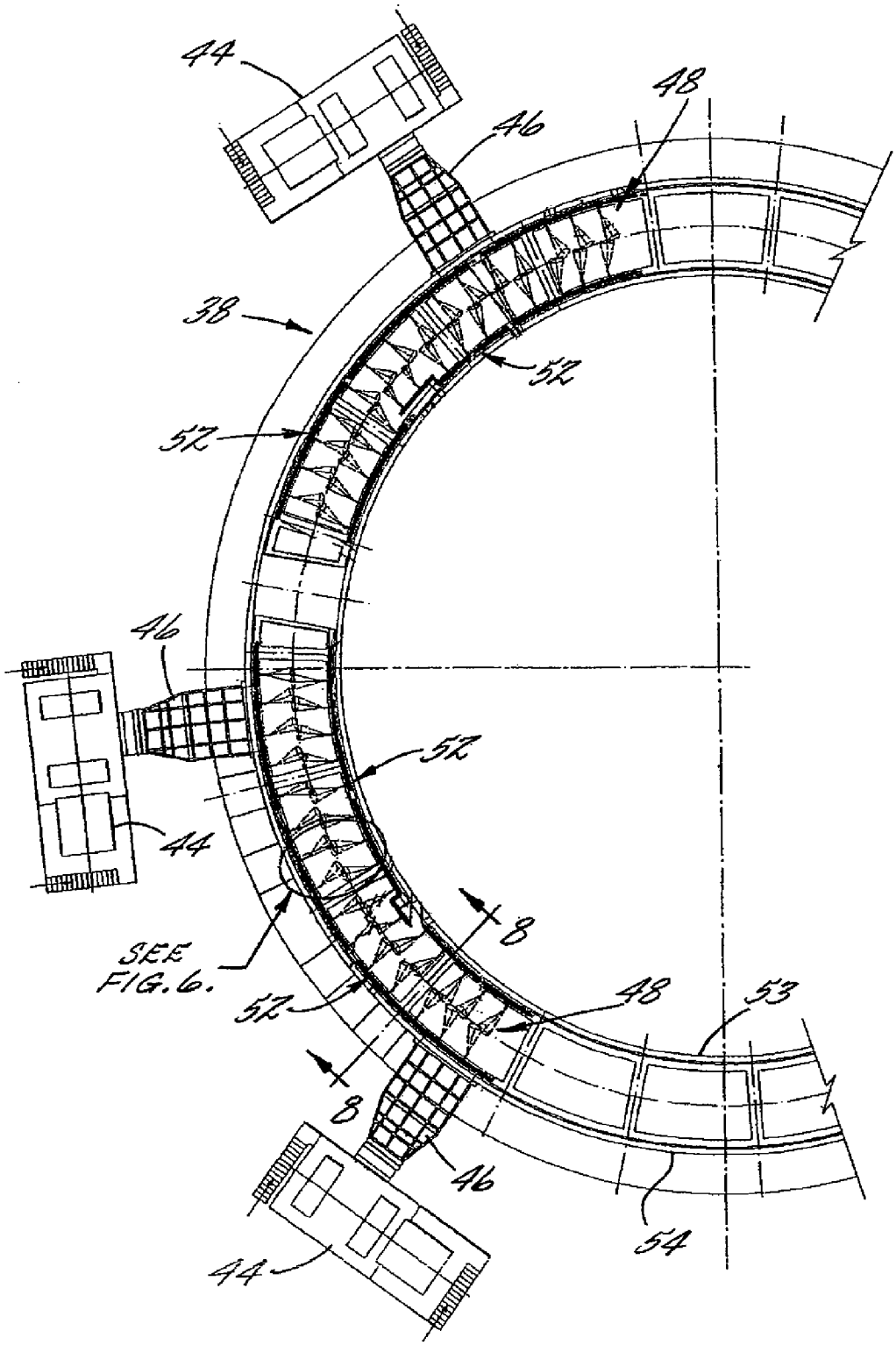
FIG. 5 is a cutaway, partial top view of the carousel conveyor of FIG. 4 showing the evaporative cooling units.
Figure 6:
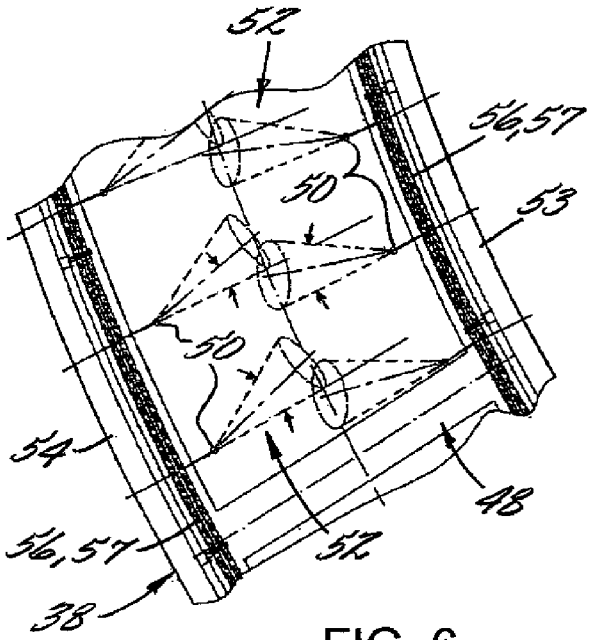
FIG. 6 is an enlarged cutaway partial top view of the carousel conveyor of FIG. 4 showing the arrangement of some of the spray nozzles of one of the evaporative cooling units.
Figure 7:
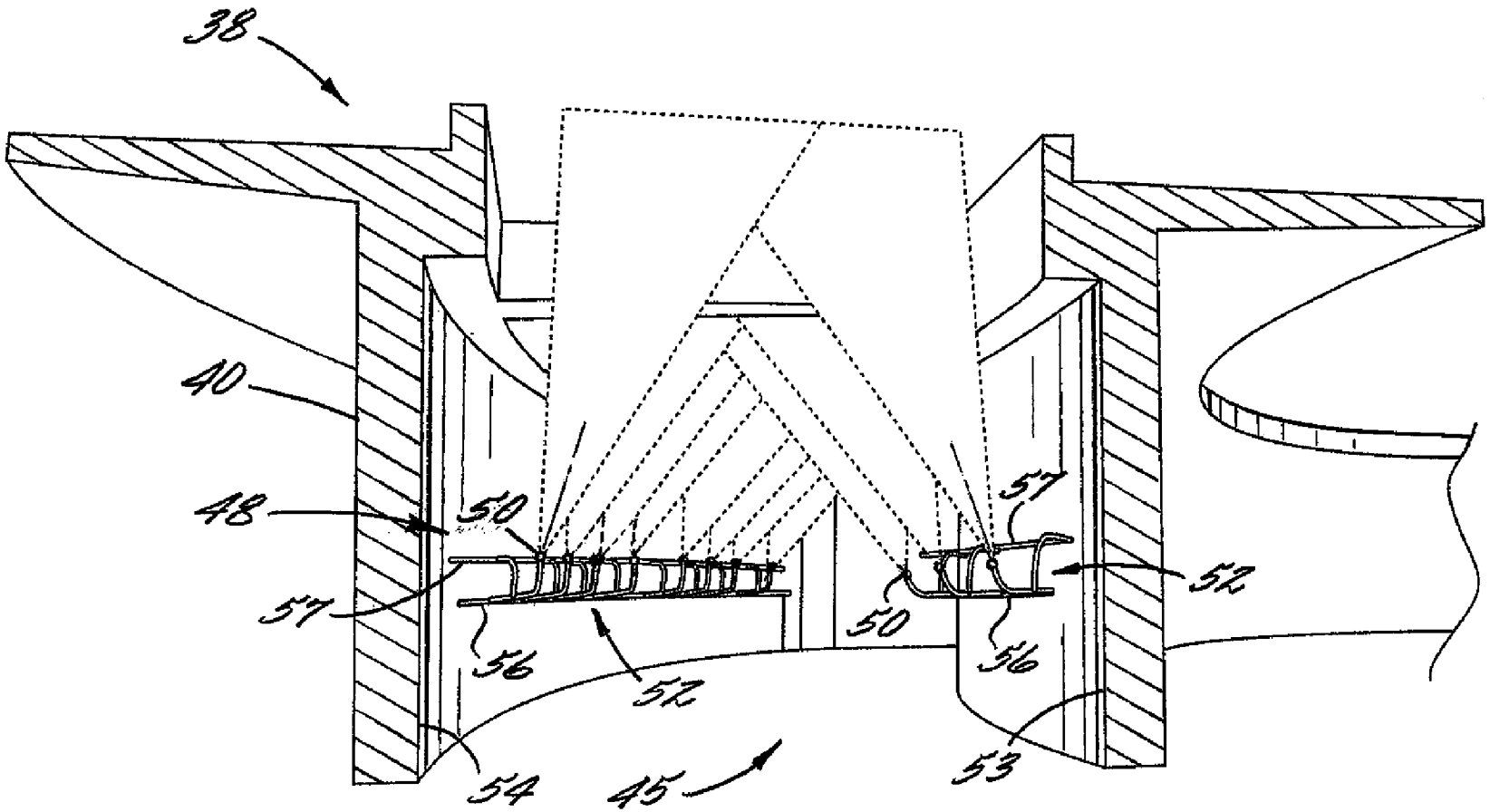
FIG. 7 is a perspective view of air chamber beneath the carousel conveyor of FIG. 4 showing the spray nozzles of one of the evaporative cooling units according to the invention.

To ensure adequate spray coverage of the hot sinter, the spray nozzles 50 of each evaporative cooling unit 48 are divided into a plurality of arrays 52 including a pair of arrays that are, in this case, distributed along the inner and outer walls 53, 54 of the air chamber 45 opposite each other as shown in FIGS. 5-8. The spray nozzles 50 are arranged, aimed and have a discharge pattern that ensures that, between the opposing arrays 52 of spray nozzles, liquid is directed across the entire width of the carousel conveyor 38. In the illustrated embodiment, each evaporative cooling unit 48 includes two pairs of opposing spray nozzle arrays 52 in circumferentially spaced relation in the air chamber 45 beneath the carousel conveyor 38 (see FIG. 5). Each array of spray nozzles 50, in this case, includes ten spray nozzles that are connected to a common liquid manifold 56 that extends along and is supported on the respective wall 53, 54 of the air chamber 45 (see FIGS. 5 and 7). The spray nozzles 50 of each array 52 are also connected to a common air manifold 57 that is also supported on the respective wall 53, 54 of the air chamber 45. In this case, as shown in FIG. 6, the spray nozzles 50 of opposing arrays 52 are circumferentially staggered so as to help achieve sufficient coverage of the carousel conveyor 38. The particular number of spray nozzles and arrays used as well as their arrangement will depend on the area that is to be covered and the desired liquid flow rate.

Figure 9:
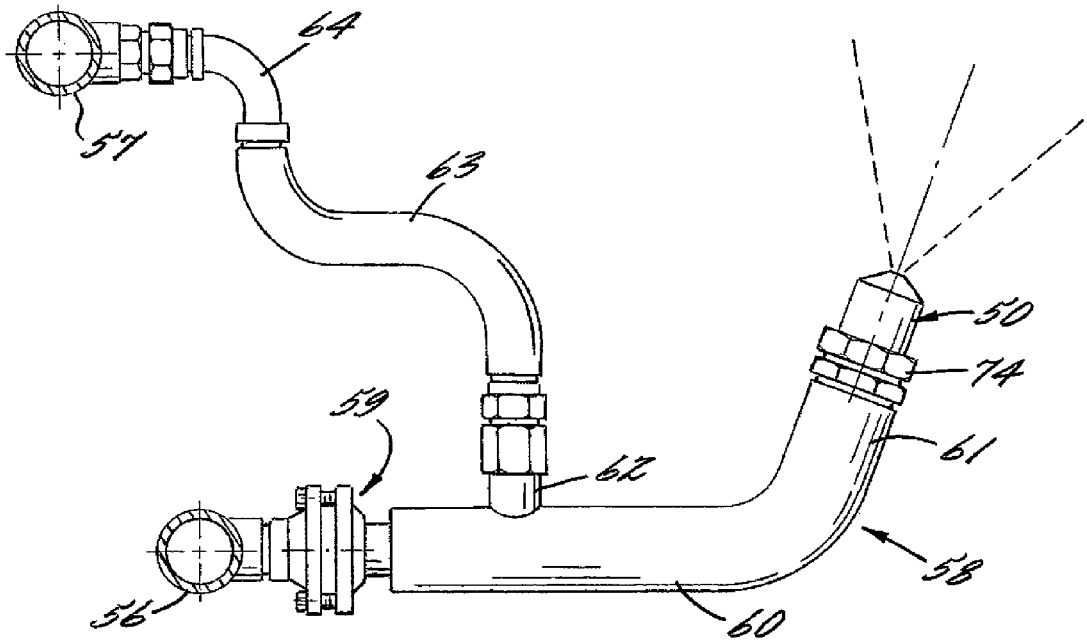
FIG. 9 is a side view of one of the spray nozzles and supporting lances of the evaporative cooling unit of FIGS. 5-7.

As shown in FIG. 9, each of the spray nozzles 50 is arranged at the end of a supporting lance 58 that is connected to the liquid manifold 56. In this instance, the lance 58 is connected to the liquid manifold 56 by an adjustable ball fitting 59 that facilitates the assembly and positioning of the lance and hence the spray nozzle. The lance 58 includes an elongate substantially straight body portion 60 that extends perpendicularly away from the liquid manifold 56 and an angled portion 61 that is downstream of the body portion 60. An air connection port 62, in this case, extends upward from the body portion 60 of the lance 58 and to which an air line 63 that extends to the air manifold 57 can be connected for supplying air to the spray nozzle 50. The illustrated air line 63 is a flexible conduit that communicates with an elbow fitting 64 that is connected to the air manifold 57. In a known manner, the lance 58 includes inner passageways for carrying the liquid and the air to the spray nozzle 50.

The spray nozzle 50 itself is arranged at the downstream end of the angled portion 61 of the lance 58. According to one embodiment, this angled portion 61 can be adjustable, manually or otherwise, so as to help provide maximum flexibility during set-up and adjustment of the evaporative cooling unit 48. The desired angle of the angled portion 61 of the lance 58 is determined based on several factors including the angle of the discharge pattern produced by the spray nozzle 50, the width of the carousel conveyor 38, the position of the spray nozzle relative to the edge of the carousel conveyor 38 (see, e.g., FIG. 8) and any equipment or other obstacles that may be present in the air chamber between the nozzle and the carousel conveyor. As previously noted, the positions, inclination angles and discharge pattern angles of the spray nozzles 50 should be selected such that opposing arrays 52 of spray nozzles achieve complete coverage of the entire width of the carousel conveyor 38. As will be appreciated, the spray nozzles 50 do not have to be arranged in any particular location or pattern beneath the carousel conveyor 38 so long as they achieve adequate coverage of the conveyed hot sinter. For example, as opposed to being arranged on the inner and outer walls 53, 54 of the air chamber 45, the spray nozzles 50 could be arranged more towards the center of the air chamber.

Figure 10:
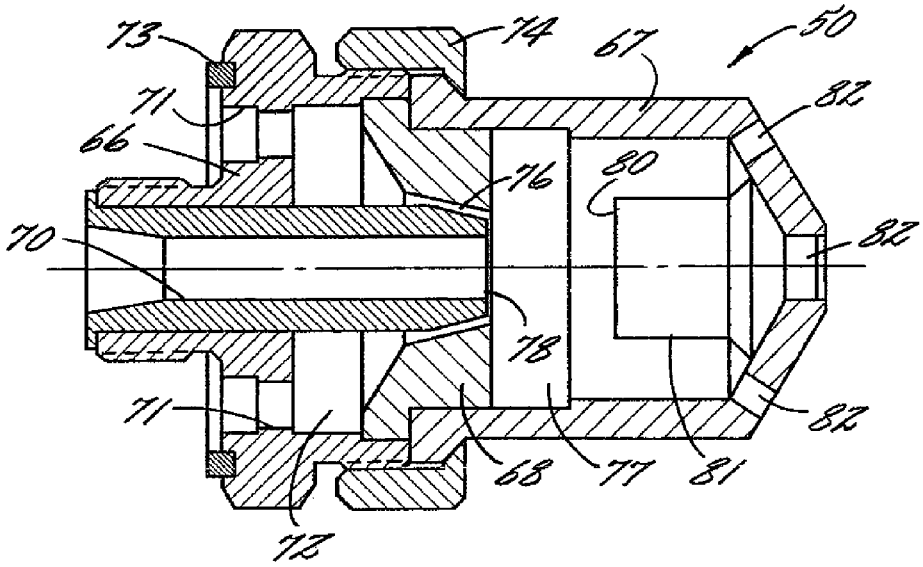
FIG. 10 is a longitudinal cross-section view of an illustrative air-atomizing spray nozzle used in the evaporative cooling unit according the invention.

To help maximize the efficiency of the evaporative cooling unit 48, the spray nozzles 50 can be configured to effectively atomize and break down the liquid using a minimal amount of compressed air. Minimizing the compressed air requirements helps reduce the overall component cost of the evaporative cooling unit as well as the operating cost of the unit by reducing the energy consumption of the system. In this case, as shown in FIG. 10, the spray nozzles 50 basically comprise a nozzle body 66, a downstream spray tip 67 and an air guide 68 interposed between the nozzle body and the air guide. The nozzle body 66 in this case has an inner axially extending liquid supply tube 70 and a plurality of circumferentially spaced axially extending air passageways 71 that communicate with an air chamber 72 about the liquid supply tube 70. An annular sealing ring 73 is provided at the downstream end of the nozzle body 66 that connects to the lance 58 for facilitating a tight seal between the nozzle body and the lance.

The spray tip 67 is secured to the nozzle body 66 by a coupling nut 74 with the air guide 68 retained between an upstream end of the spray tip 67 and a counter bore in the downstream end of the nozzle body 66. The downstream end of the liquid supply tube 70 and a central bore of the air guide 68 are formed with respective tapered surfaces which define an inwardly, converging annular air passageway 76. This annular air passageway 76 directs pressurized air from the annular air chamber 72 into an expansion chamber 77 within the spray tip 67 simultaneous with liquid that is directed through and out a downstream discharge orifice 78 in the liquid supply tube 70. The discharging liquid impacts a transverse impingement surface 80 defined by an upstanding impingement pin 81 in the spray tip 67 that enhances both mechanical and air atomized liquid particle breakdown as it is dispersed laterally relative to the impingement surface 80.

The lateral liquid dispersion is further broken down and atomized by the annular air flow stream prior to discharge from the spray tip 67 through a plurality of circumferentially spaced discharge orifices 82 disposed in surrounding relation to the impingement pin 81. The illustrated spray nozzles 50 are substantially similar to the nozzles disclosed in U.S. Pat. No. 7,108,203 which is owned by the assignee of the present application and is hereby incorporated herein by reference. Of course, while the illustrated nozzles have benefits with regards to reduced air consumption, the evaporative cooling units could use other types of air atomized spray nozzles. To help minimize the pressurized air requirements while still achieving adequate penetration of the discharged liquid into the sinter, the annular air passageway defined by the air guide and the downstream end of the liquid supply tube is relatively smaller than heretofore used on such spray nozzles.

Figure 11:
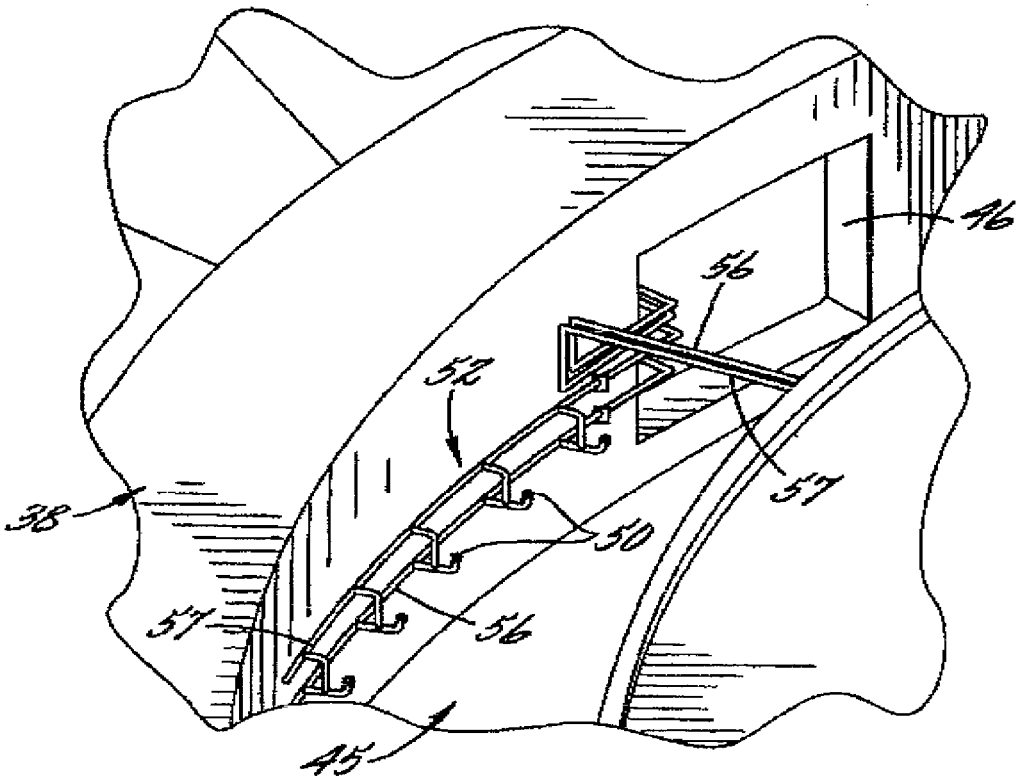
FIG. 11 is a cutaway partial perspective view of the carousel conveyor of FIG. 4 showing the feed of the air and liquid manifolds for an evaporative cooling unit.

To help enhance the evaporative cooling effect, each evaporative cooling unit 48 can be associated with one or more respective fan units 44. For example, in the illustrated embodiment, each evaporative cooling unit 48 is arranged in the vicinity of the discharge plenum 46 of a respective fan unit 44. It has been found that the air from the fan units 44 interacts in a beneficial manner with the atomized liquid spray produced by the evaporative spray units 48 by helping to drive the liquid upward into the sinter carried on the carousel conveyor 38. This helps the liquid penetrate into the sinter and thereby enhances the evaporative cooling effect. However, it is also contemplated that one or more evaporative cooling units 48 will alternatively be installed apart from any fan unit 44. In this case, the three evaporative cooling units 38 associated with the illustrated cooling system 35 are each arranged near a respective one of the middle three fan units 44 as shown in FIG. 5 and the first and last or fifth fan units do not have associated evaporative cooling units. To facilitate routing of the liquid and air manifolds 56, 57 to the air chamber 45 beneath the carousel conveyor 38, the manifolds can be fed through the discharge plenums 46 of the fan units 44 as shown in FIG. 11.

Figure 12:
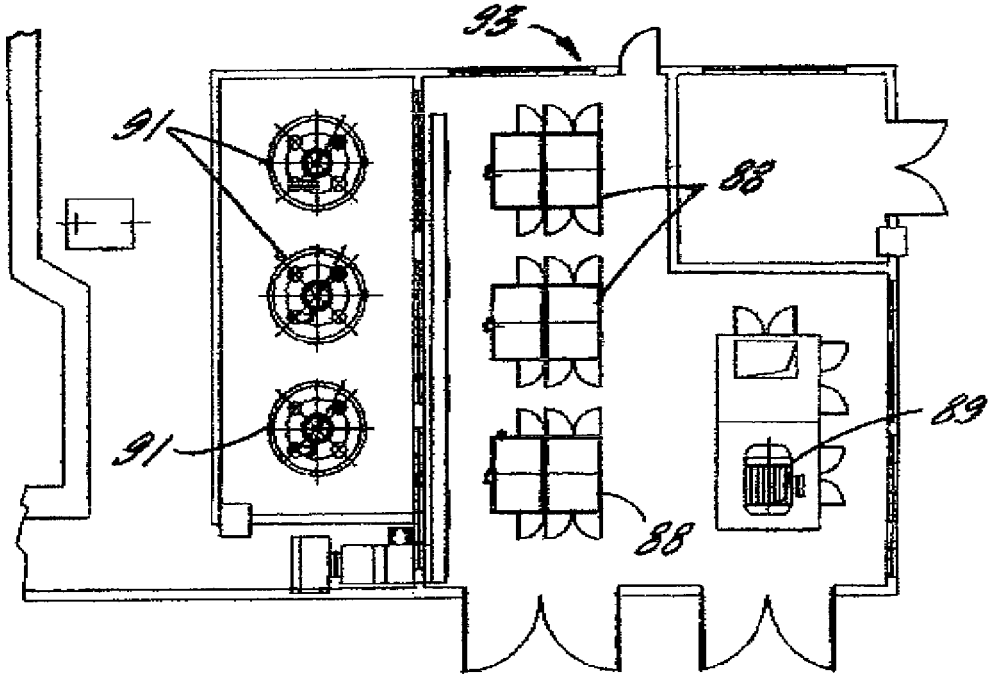
FIG. 12 is a cutaway top view of a control room for the evaporative cooling units of the cooling system of FIGS. 5-7.
Figure 13:
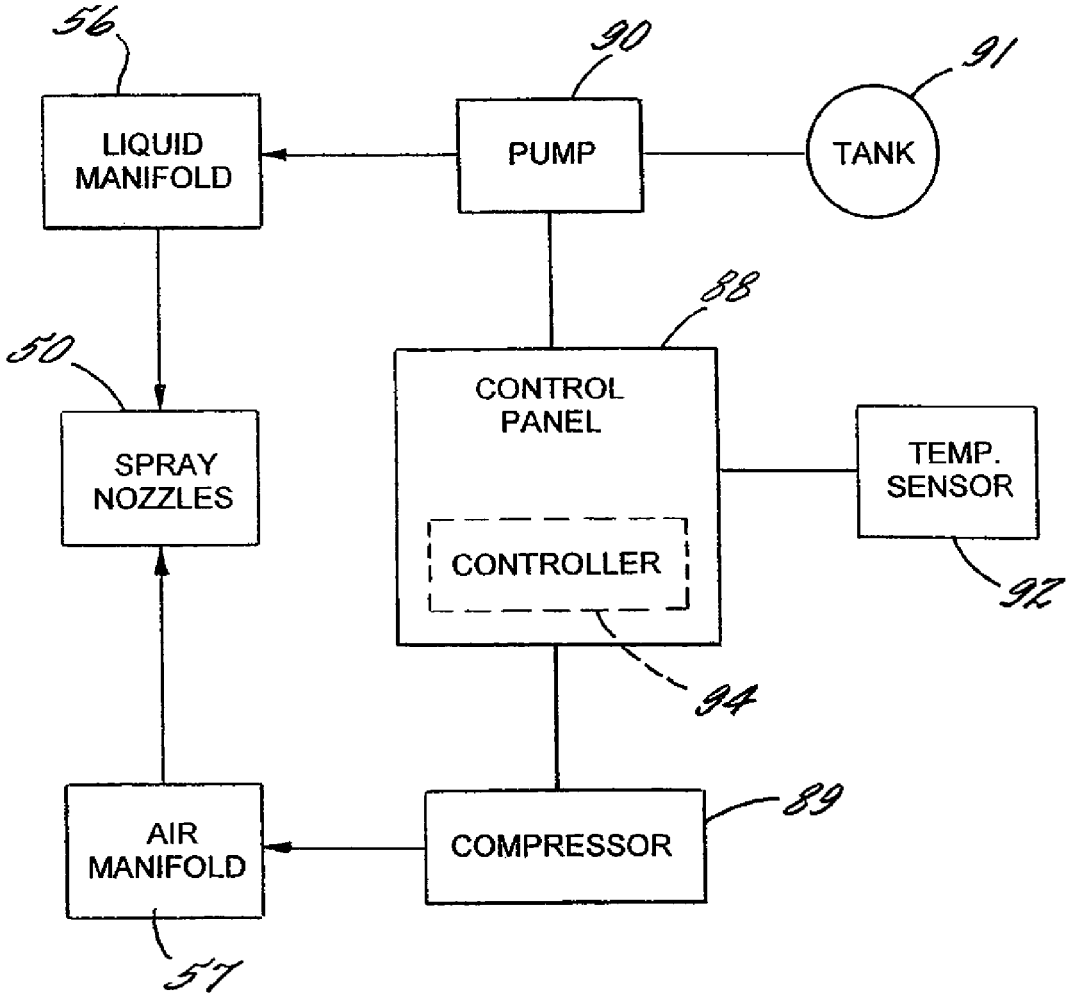
FIG. 13 is a schematic diagram showing an illustrative control panel for an evaporative cooling unit according to the invention.

In further keeping with the invention, referring to FIG. 13, each evaporative cooling unit 48 also can include an associated control panel 88. In the illustrated embodiment, the control panel 88 associated with each evaporative cooling unit 48 is arranged in a control room 93 that can be arranged near the outer perimeter of the carousel conveyor 38 (see FIG. 12). For supplying pressurized air to the spray nozzles 50, the control panel 88 can have or control an associated air compressor 89 in communication with the various air manifolds 57 as shown in FIG. 13. The air compressor 89 functions in a known manner to take input atmospheric air and output a stream of pressurized air. The control panel 88 can further include and direct operation of suitable valves that are used to open and shut off the supply of pressurized air to the individual air manifolds 57. The use of minimal air consuming nozzles like those described above and shown in FIG. 10 can enable several evaporative cooling units 48 to share a common air compressor (such as shown in FIG. 12) in which case operation of the compressor can be effected by the control panel 88 of one or more of the evaporative cooling units 48 with the individual control panels directing operation of valves controlling the supply of the pressurized air from the air compressor to the individual air manifolds associated with that evaporative cooling unit.

The control panel 88 of each evaporative cooling unit can have or control an associated water pump 90 for supplying pressurized water to the spray nozzles 50 via the liquid manifolds 56 as shown in FIG. 13. The water pump 90 can obtain input fluid from any suitable source, but in a preferred embodiment of the invention, the pump is supplied with water via a tank 91. In this case, each evaporative cooling unit has a respective tank 91 with the tanks being arranged adjacent the control room as shown in FIG. 12. In this way, the water pressure at the input of pump 90 is gravitational only and is not influenced by pressure variations in local municipal or other water supplies. The control panel 88 can further include and direct operation of suitable valves for open and shutting off the supply of fluid to the individual liquid manifolds 56 associated with that evaporative cooling unit 48 (see FIG. 13). As with control of the compressed air supply, multiple evaporative cooling systems 48 may be supplied by a single tank and pump 91, 90 with the individual control panels 88 controlling the flow to the fluid manifolds associated with that evaporative cooling unit 48. The control panels 88 for the evaporative cooling units 48 can, of course, have different configurations and capabilities. Moreover, a single control panel 88 may be provided to control the air and fluid supply to multiple evaporative cooling units 48. According to one embodiment of the invention, the control panel or panels can comprise AutoJet Model 2250 Spray Controllers which are available from Spraying Systems Inc. of Wheaton, Ill.

Instead of providing a central or common control room for the control panels, pumps, tanks and air compressor as in the illustrated embodiment, this equipment also could be arranged in multiple locations. For instance, the equipment associated with a respective evaporative cooling unit could be arranged in a cluster or a smaller control room near that evaporative cooling unit. Other arrangements are also possible.

For providing an ability to automatically adjust the operation of the evaporative cooling units 48, a temperature sensor 92 can be provided that is adapted to sense the temperature of the sinter on the carousel conveyor 38 after it has been processed to a desired point or location. As shown in FIG. 13, the temperature sensor 92 can be in communication with a processor or controller 94 that directs operation of the various aspects of the operation of the cooling system including for example the evaporative cooling units. The controller 94 may be embedded in or associated with the control panel 88 of one of the evaporative cooling units 48 or it may be associated with a plurality of control panels 88. Based on the information from the temperature sensor 92, the controller 94 can execute the necessary steps (e.g., adjusting the flow of liquid through the fluid manifolds 56) to adjust the droplet size or flow rate from the spray nozzles 50 if the sinter is cooling too quickly or too slowly. Any suitable sensor may be used, but in an embodiment of the invention, the sensor 92 comprises an IR (infrared) sensor directed toward the sinter arranged in the passing carousel conveyor 38.

In a further embodiment of the invention, the sensor 92 can comprise an array of individual sensors that are, for example, arranged side-to-side relative to the width of the conveyor 38 and/or arranged top-to-bottom relative to the depth of the conveyor 38. In this way, the sensor 92 can produce an indication of average temperature or alternatively may produce a spatial temperature distribution indication to evaluate the uniformity of cooling. For example, the sinter may cool more quickly on one side or the other, or it may cool more quickly on the top or bottom. Detecting these errors will allow them to be timely corrected or accommodated.

Although it may not be easily accomplished or possible with current sinter processing lines it is conceivable that the temperature feedback from sensor 92 also could be used additionally or alternatively to speed or slow the progression of the sinter through the cooling system. In such an embodiment, the controller 94 would also control the operational aspects of the carousel conveyor 38 carrying the sinter and if, for example, the sinter is cooling uniformly but is nonetheless too hot when measured, the controller 94 could adjust speed of the carousel conveyor 38 so that more cooling takes place per unit of travel.

In order to provide progressive and further controlled cooling of the sinter, the cooling system 35 may be divided into a plurality of cooling zones. In the illustrated embodiment, the cooling system 35 can be divided into a total of five cooling zones with each cooling zone having a respective fan unit and the middle three cooling zones (i.e., cooling zones 2, 3 and 4) also having associated evaporative cooling units 48. In this case, the first cooling zone which is arranged just downstream of where the hot sinter is fed onto the carousel conveyor 38 and the last cooling zone which is arranged just before the sinter is discharged from the carousel conveyor do not have associated evaporative cooling units. While the illustrative embodiment includes three cooling zones with evaporative cooling units and a total of five cooling zones, but it will be appreciated that the cooling system can comprise more or fewer cooling zones and more or fewer of those cooling zones can be equipped with evaporative cooling units.

Figure 14:
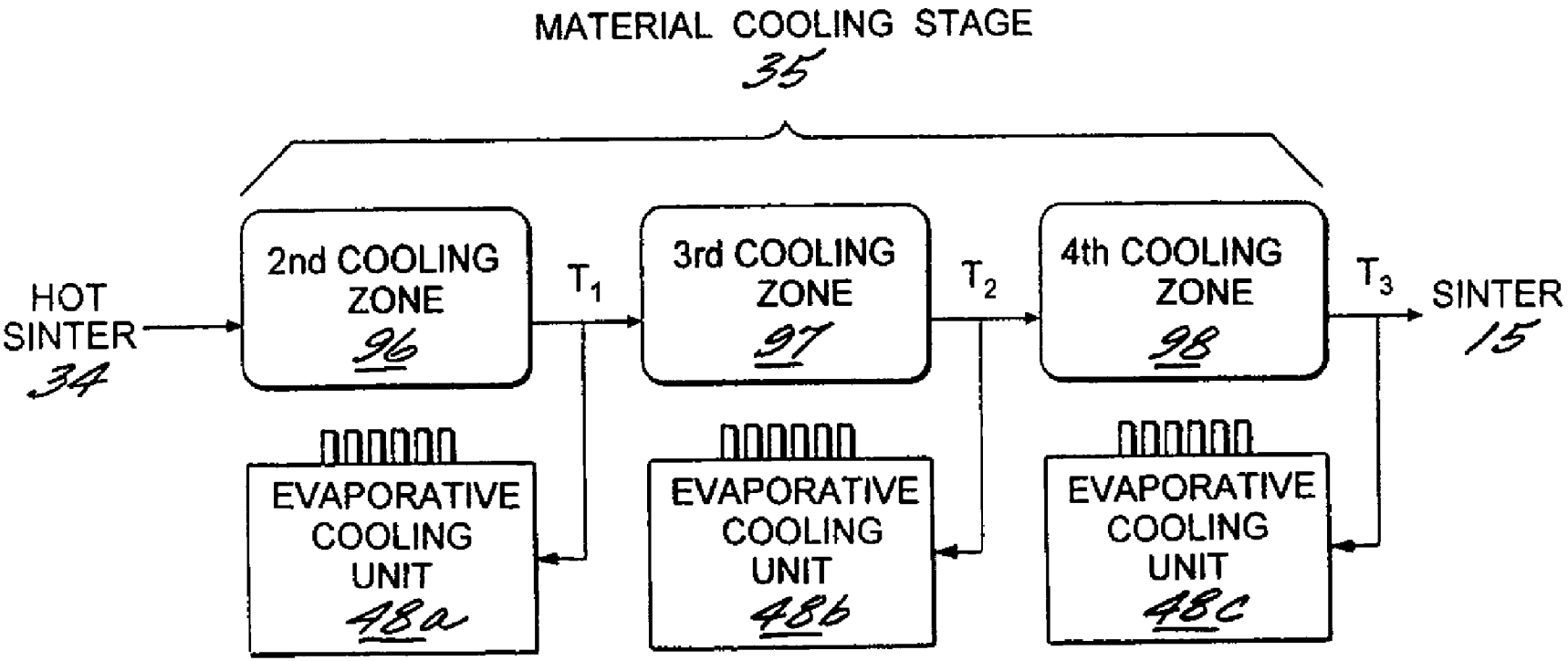
FIG. 14 is a schematic drawing of an illustrative sinter cooling system according to the invention that is divided into a plurality of cooling zones.

FIG. 14 provides a schematic flow diagram illustrating the operation of the three cooling zones, i.e. the second cooling zone 96, third cooling zone 97 and fourth cooling zone 98, equipped with evaporative cooling units. As noted above, the hot sinter 34 enters the cooling system 35 from the ignition furnace via a first cooling zone that is not equipped with an evaporative cooling unit. The hot sinter is then passed from the first to the second cooling zone. As the hot sinter 34 traverses the second cooling zone 96, it is cooled via a first evaporative cooling unit 48*a* such as that described above with respect to FIGS. 5-8. It will be appreciated that each zone may comprise more than one evaporative cooling unit and that one or more zones may also employ a fan unit for convective cooling. The sinter 34 is cooled within the second cooling zone 96 to a first target temperature $T_1$. The controller 94 (see FIG. 13) associated with the first evaporative cooling unit 48*a* detects the temperature of the output of the second zone 96 in order to adjust the operation of the cooling unit 48*a* (e.g., by adjusting the flow of liquid to the spray nozzle) so that the sinter departing the second zone 96 is at a temperature that substantially matches $T_1$.

In a similar manner, the third cooling zone 97 further cools the sinter 34 via the second evaporative cooling unit 48*b* so that the temperature of the sinter is substantially at target temperature $T_2$ as shown in FIG. 14. At this point, the sinter 34 is passed to the fourth cooling zone 98, where its temperature is reduced to $T_3$ via the third evaporative cooling unit 48*c*. $T_3$ should be low enough that the sinter will leave the subsequent fifth cooling zone, which has no evaporative cooling unit, at acceptable output temperature for the sinter. Depending upon the particular operational parameters, it is possible that one or more of the cooling zones may be inactive at times. An initial set point for the first cooling, and subsequent, zones can be determined by estimating the amount of heat that has to be removed from the sinter using the temperature of the sinter when it enters the cooling system and a measurement of the permeability of the sinter after it is discharged from the cooling system.

As noted previously, the controller 94 may control aspects of the sinter line in addition to the operation of the evaporative cooling units. For example, the controller 94 may control and/or receive information from the fan units 44, and may control the movement of the sinter through the entire sinter cooling system 35, such as by accelerating or slowing operation of the charging system 42 or the passage of the sinter on the carousel conveyor 38. The controller 94 preferably operates in accordance with computer-readable instructions (e.g., machine, object, or other code or programming) stored on a computer-readable memory such as a volatile or nonvolatile memory permanently or transiently associated with the processor or controller. The controller 94 may also incorporate or utilize a network link to convey information to another computer or computer system, or a communication device such as a cell phone or the like. The link may be a wide area link (WAN), local are link (LAN), cellular link, etc., and may be wired or wireless. In an embodiment of the invention, the network link comprises a link directly or indirectly to the Internet or World Wide Web.

Figure 15:
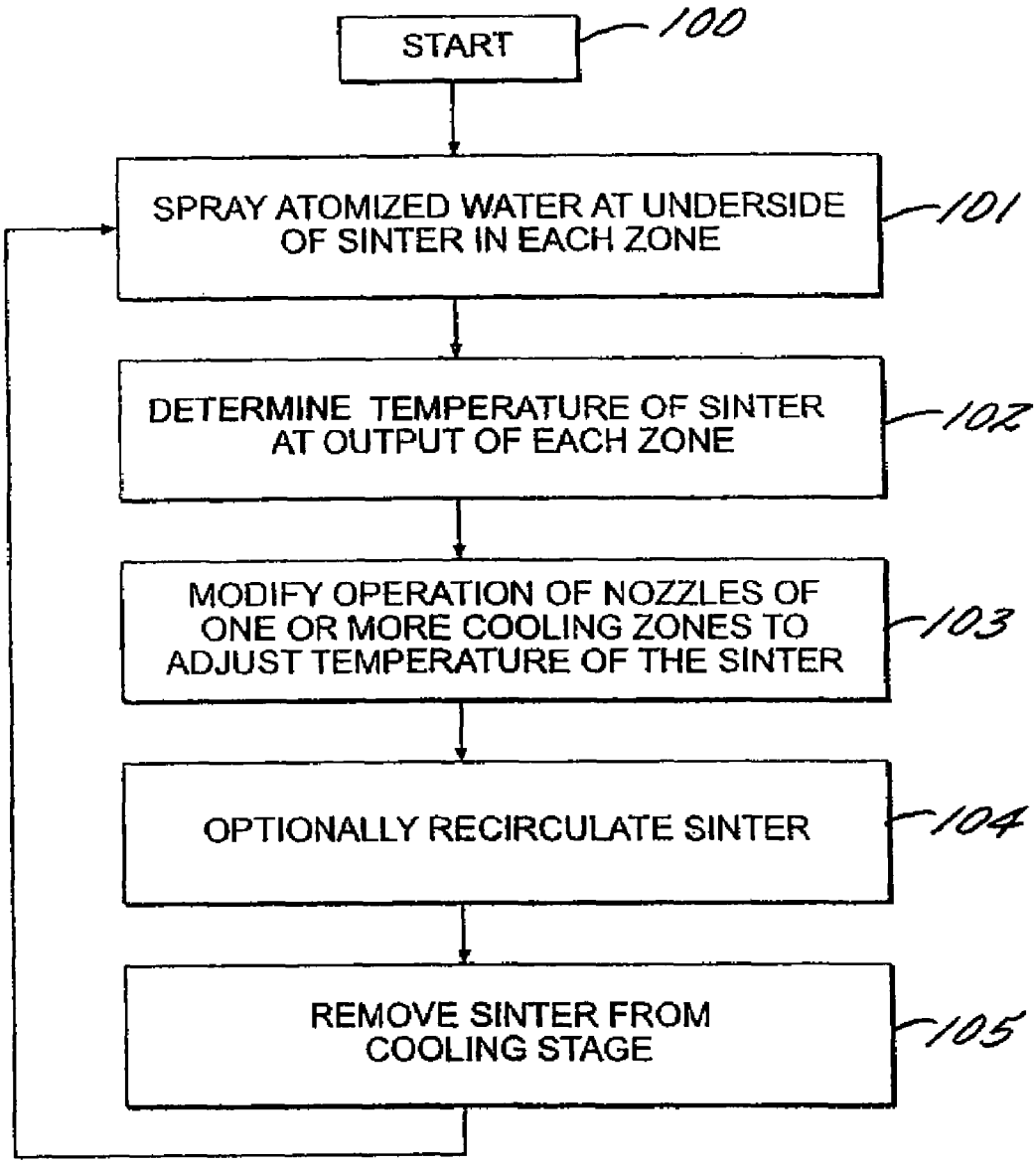
FIG. 15 is a flow chart of an exemplary process for controlling the sinter cooling system of FIG. 13.

Control of the sinter cooling system 35 is preferably executed automatically via the controller 94, through execution of computer-executable instructions, e.g., compiled programming instructions, on a computer-readable medium, e.g., volatile or non-volatile memory containing the instructions. The instructions may encode any suitable control strategy in keeping with the broad principles described herein. However, in an embodiment of the invention, the instructions encode the process 100 illustrated in the flow chart of FIG. 15. Although the process 100 assumes that the sinter has already entered the cooling system, it will be appreciated that the controller may also control steps prior to or subsequent to those shown.

At stage 101 of the process 100, the controller directs the evaporative cooling system to spray atomized water at the underside of the sinter in each zone of one or more cooling zones in the cooling stage 96. This atomized spray is typically though not necessarily applied in addition to the forced air also directed at the sinter in each zone. The controller 94 determines the temperature of the sinter at the output of each zone at stage 102. Typically, the sensing of temperature will employ non-contact means such as IR or other EMF (electromagnetic field) radiation sensors as described above and will yield a measurement of the temperature at multiple points in the sinter at each such output. For example, two or more temperature readings may be taken at different points across the width of the sinter. Alternatively, a single point may be measured at one or more zone outputs.

At stage 103, the controller 94 modifies the spray operation of one or more nozzles or arrays of nozzles associated with the evaporative cooling units of one or more cooling zones to adjust the temperature of the sinter. For example, in an embodiment of the invention, the evaporative cooling unit 48, or a portion thereof such as one array of spray nozzles 50, of each of the one or more cooling zones can be adjusted based on the temperature at the output of that zone. Alternatively, the temperature at the output of one zone may be used instead or in addition to adjust the operation of the nozzles or arrays of nozzles of the evaporative cooling unit of a down-stream zone. One way in which this could be accomplished is by using control algorithms that determine the amount of water that should be added in each cooling zone for a desired temperature. The amount of water being added is then set, for example, by adjusting (as necessary) the respective water pump 90. The measured temperature is then compared on a periodic basis to the desired temperature and, if there is a divergence, a new water flow rate is recalculated using the control algorithm and the respective water pump is adjusted accordingly.

Additionally, by way of example, the temperature reading at the output of a first zone may indicate that the temperature on one side of the sinter is above a desired output temperature, while the temperature at another side of the sinter at the same output is at the desired temperature. In such a case, the controller 94 may adjust the first evaporative cooling unit so that the spray nozzle arrays directed to the first side have greater fluid flow and/or atomization to reduce the temperature in the sinter there. Alternatively or additionally, the controller 94 may adjust the operation of an evaporative spray unit in a subsequent stage to correct the temperature imbalance. It will be appreciated that the final zone has no subsequent zone, and that thus any desired adjustments with respect to the sinter temperature at the output of the final zone must be executed in or before the final stage.

Again, while it may not be easily accomplished with current sinter processing lines, it is conceivable that additionally or alternatively the sinter may be recirculated at stage 104. For example, if the sinter at the output of the final zone exceeds a predetermined threshold temperature, the controller 94 may recirculate the sinter through the cooling system 35. In the illustrated embodiment of the invention wherein the sinter travels around the circular carousel conveyor in the cooling system, the controller could cause the sinter to continue on the carousel conveyor rather than diverting it into a collection hopper or conveyer. Finally at stage 105, the sinter is removed from the cooling system 35.

It will be appreciated that the illustrated control steps will typically be executed continuously and simultaneously once the sinter cooling system 35 is in operation. Thus, the controller 94 will typically measure the output of each zone contemporaneously and will make all needed adjustments and diversions contemporaneously. However, the steps are shown sequentially in process 100 for ease of understanding.

The foregoing operations may be executed with any suitable parameter values with respect to particular installations and implementations. However in an embodiment of the invention, certain parameter values generally prevail and/or are thought to be desirable. For example, in a 1,250 ton/hour facility, the area impacted by the discharge from the spray nozzles 50 of one complete evaporative cooling unit 48 can be approximately 400 $m^2$ in one embodiment of the invention with a sinter density of about 1.6 $t/m^3$. The temperature of the hot sinter typically depends upon the particular installation, but may be about 700° C., with a desired output temperature of the cooled sinter being between about 130° and 140° C. The flow rate of the fan units 44 will vary according to designer preferences but are typically between about 7000 and 8000 m3/min at 35 mbar pressure and ambient atmospheric temperature.

The evaporative cooling units 48 and the included spray nozzles 50 can be of any suitable configuration and operation, but in an embodiment of the invention, each evaporative spray unit delivers a water flow rate of approximately 17 L/min per nozzle (a total >340 L/min per evaporative spray unit) at a pressure of approximately 2.5 bar to the spray nozzles. The air flow delivered by each evaporative spray unit 48 to its respective spray nozzles 50 in this embodiment of the invention is approximately 73 kg/h at a pressure between approximately 2 bar and approximately 4 bar. With the nozzle illustrated in FIG. 10 above, this provides a maximum droplet size of about 120-160 microns, which has been found to be suitable for cooling at one or more zones of the cooling system 35.

At the same production rate as prior systems, a single evaporative cooling unit 48 has been found to provide an approximately 60-80° C. drop in maximum sinter temperature at the outlet, and an average temperature drop at the outlet of 10-20° C. as compared to a system using cooling zones with only fan units. This allows the entire sinter production line to move 25% more quickly with a corresponding increase in production of approximately 25% over such prior systems, without an increase in output temperature.

The output sinter is also found to exhibit a slight (~0.35%) decrease in small (<5 mm) particle content and an increase (~0.6%) in shatter strength as measured using a known Shatter Index (SI). In order to be usable as blast furnace feed, the processed sinter must be between about 0.5 to 2.0 inches in diameter. Smaller pieces produced from the sintering process cannot be used and are recycled to be sintered again. Thus reducing the small particle content and the increasing the shatter strength of the output sinter increases the output and efficiency of the sintering process. This also increases the output and efficiency of the blast furnace in which the output sinter is used The cooling process described herein appears to decrease crack formation in the sinter, but more importantly also appears to decrease crack propagation. Cracks initiate in sinter particles when hematite present reduces to magnetite. For this reason, increasing sinter porosity can lead to higher RDI (reduction degradation index) and increased shatter resistance. It appears that the cooling process described herein affects this and other parameters positively thereby increasing the yield of usably sized sinter pieces. In this regard, it is believed that the uniform distribution of liquid produced by the evaporative cooling units along with the air produced by the fan units combine to produce a soft cooling that helps to reduce the stress in the sinter.

The metallurgical properties of the output sinter may also be enhanced via use of the described improved cooling system. As described above, the sintering process involves appropriately reacting ores, fluxes and additives at high temperatures or incorporating those materials in the sinter structure if they remain unreacted. The reactions involved are complex, and they can depend considerably on chemical composition, mineralogy, size and porosity of the involved materials. As the hot sinter which has been heated to its maximum temperature begins to cool, liquid constituents begin to solidify, precipitating many kinds of minerals. According to some models, the minerals that precipitate during the cooling stage are magnetite, hematite, calcium ferrite and calcium silicate.

The degree of complexity of sintering reactions increases with increased ores used in the mixtures. Iron ores present quite different properties at high temperatures. The complexity of sintering reactions is also highly influenced by the growing amount of industrial wastes generated during metallurgical processes that are recycled through sintering.

It will be appreciated that the foregoing description provides examples of the disclosed system and technique. However, it is contemplated that other implementations of the disclosure may differ in detail from the foregoing examples. All references to the invention or examples thereof are intended to reference the particular example being discussed at that point and are not intended to imply any limitation as to the scope of the invention more generally. All language of distinction and disparagement with respect to certain features is intended to indicate a lack of preference for those features, but not to exclude such from the scope of the invention entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An apparatus for processing iron sinter comprising:

a furnace for heating materials for forming hot iron sinter, a cooling system arranged downstream of the furnace for cooling the iron sinter, said cooling system comprising a rotatable cooling carousel, a charging inlet for directing hot iron sinter from the furnace onto the rotating carousel at an inlet station, a plurality of convective cooling stations disposed at circumferentially spaced locations about the carousel, said convective cooling stations each including an air chamber disposed below said carousel and a fan for generating forced air and directing the forced air into the air chamber and in turn upwardly from the air chamber onto an underside of iron sinter as it is carried and moved by the carousel, a plurality of evaporative cooling stations disposed at circumferentially spaced locations about the carousel, said evaporative cooling stations each including a plurality of spray nozzles for directing a cooling fluid onto the iron sinter from an underside as it is carried and moved by the carousel, said fan for each convective cooling station being disposed outside of said air chamber, said liquid spray nozzles of said evaporative cooling stations being disposed within the air chamber of said convective cooling stations such that the discharge of cooling fluid from the liquid spray nozzles within the air chamber is further carried by the current of air discharging from the fan of the convective cooling station upwardly onto the underside of hot iron sinter as it is carried by the carousel, a plurality of temperature sensors for sensing the temperature of the iron sinter as it is carried by the carousel, a controller responsive to the temperatures sensed by the temperature sensors for controlling the flow of fluid from the spray nozzles of the evaporative cooling stations based upon predetermined temperature settings of the controller, and a cooled iron sinter discharge station for removing the iron sinter from the carousel after being cooled by the plurality of convection and evaporative cooling stations.

2. The apparatus of claim 1 wherein each liquid spray nozzle is an air atomizing spray nozzle.

3. The apparatus of claim 1 wherein each evaporative cooling station includes a plurality of liquid spray nozzles disposed at longitudinally spaced intervals in a direction of travel of the iron sinter through the cooling system.

4. The apparatus of claim 3 wherein each evaporative cooling station includes a plurality of headers each supporting at least one liquid spray nozzle and wherein the spray nozzles of at least two of the headers are arranged adjacent opposite edges of a path of travel for the iron sinter through the cooling system.

5. The apparatus of claim 1 wherein the liquid spray nozzles of each evaporative cooling station are arranged in a discharge path of the forced air of the convective cooling station.

6. The apparatus of claim 1 wherein each evaporative cooling system is connected to a liquid supply source comprising a tank.

7. The apparatus of claim 1 wherein responsive to the temperature sensed by the temperature sensor of each evaporative cooling station controls operation of the spray nozzles of an evaporative cooling station downstream of the evaporative cooling station in which the respective temperature sensor is arranged.

8. An apparatus for processing iron sinter comprising:

a furnace for heating materials for forming hot iron sinter, a cooling system arranged downstream of the furnace for cooling the hot iron sinter, said cooling system comprising a movable conveyor, a charging inlet for directing hot iron sinter from the furnace onto the moving conveyor at an inlet station for movement along the path of travel of the conveyor, a plurality of convective cooling stations disposed along the conveyor, said plurality of convective cooling stations each including a fan for generating forced air and a plenum disposed below the conveyor_for directing the forced air upwardly_onto the iron sinter as it is moved by the conveyor, a plurality of evaporative cooling stations disposed at locations along said conveyor for directing a cooling fluid onto iron sinter as it is carried and moved by the conveyor, said evaporative cooling station each including a plurality of liquid spray nozzles, said fan for each convective cooling station being disposed outside of said plenum, said liquid spray nozzles of said evaporative cooling stations being disposed within the plenums of said convective cooling stations such that the discharge of cooling fluid from the liquid spray nozzles within the plenum is further carried by the current of air discharging from the fan of the convective cooling station upwardly onto the underside of hot iron sinter as it is moving along the path of travel of said conveyor, a controller for controlling the flow of fluid to the spray nozzles of the evaporative cooling stations based upon predetermined cooling requirements, and a cooled iron sinter discharge station for removing the iron sinter from the conveyor after being cooled by the plurality of convection and evaporative cooling stations.

9. The apparatus of claim 8 wherein the liquid spray nozzle is an air atomizing spray nozzle.

10. The apparatus of claim 8 wherein each evaporative cooling station includes a plurality of liquid spray nozzles disposed at longitudinally spaced intervals in a direction of travel of the iron sinter through the cooling system.

11. The apparatus of claim 8 wherein each evaporative cooling station includes a plurality of headers each supporting at least one liquid spray nozzle and wherein the spray nozzles of at least two of the headers are arranged adjacent opposite edges of a path of travel for the iron sinter through the cooling system.

12. The apparatus of claim 8 wherein each evaporative cooling station is connected to a liquid supply source comprising a tank.

13. The apparatus of claim 8 further including a temperature sensor for sensing the temperature of the iron sinter and a controller responsive to the temperature sensed by the temperature sensor for controlling the flow of fluid to the spray nozzles of at least one of said evaporative cooling stations based on a predetermined temperature setting of the controller.

14. An apparatus for processing iron sinter comprising:

a furnace for heating materials for forming hot iron sinter, a cooling system arranged downstream of the furnace for cooling the iron sinter, said cooling system comprising a rotatable cooling carousel having a plurality of circumferentially located cooling troughs, a charging inlet for directing hot iron sinter from the furnace into the cooling troughs of the rotating carousel as the carousel is rotated, a plurality of convective cooling stations disposed at circumferentially spaced locations about the carousel, said convective cooling stations each including a air chamber disposed below the carousel and a fan for generating a forced air flow from the air chamber upwardly onto an underside of iron sinter as it is carried and moved by the carousel, a plurality of evaporative cooling stations disposed at circumferentially spaced locations about the carousel, said evaporative cooling stations each including a plurality of spray nozzles within a respective air chamber of one of said convective cooling stations for directing a cooling fluid onto the iron sinter from an underside as it is carried and moved by the carousel, a plurality of temperature sensors for sensing the temperature of the iron sinter as it is carried by the carousel, a controller responsive to the temperatures sensed by the temperature sensors for controlling the flow of fluid from the spray nozzles of the evaporative cooling stations based upon predetermined temperature settings of the controller, and a cooled iron sinter discharge station for removing the iron sinter from the carousel after being cooled by the plurality of convection and evaporative cooling stations.

15. An apparatus for processing iron sinter comprising:

a furnace for heating materials for forming hot iron sinter, said cooling system comprising a movable conveyor, a charging inlet for directing hot iron sinter from the furnace onto the moving conveyor at an inlet station for movement along the path of travel of the conveyor, a plurality of convective cooling stations disposed along the conveyor, said plurality of convective cooling stations each including a fan for generating forced air and a plenum disposed below the conveyor for directing the forced air upwardly onto the underside of the iron sinter as it is moved by the conveyor, a plurality of evaporative cooling stations disposed at location along said conveyor each including a plurality of liquid spray nozzles for directing a cooling fluid onto an underside of the iron sinter, said cooling fluid being directed from said spray nozzles in the form of spray droplets, a plurality of temperature sensors for sensing the temperature of the iron sinter as it is carried by the conveyor;

a controller responsive to the temperatures sensed by the temperature sensors for controlling a flow rate and the size of spray droplets discharging from the spray nozzles of the evaporative cooling stations based upon predetermined temperature settings of the controller, and a cooled iron sinter discharge station for removing the iron sinter from the conveyor after being cooled by the plurality of convection and evaporative cooling stations.

16. The apparatus of claim 15 in which said controller is responsive to temperatures sensed by the temperature sensors for adjusting the speed of the conveyor.

17. The apparatus of claim 15 in which said controller is responsive to temperatures sense by the temperature sensors for adjusting the rate charging inlet directs iron sinter onto the moving conveyor.

* * * * *